US005877730A

United States Patent [19]

Foster

[11] Patent Number: 5,877,730

[45] Date of Patent: Mar. 2, 1999

[54] SATELLITE DISH WITH SHIELD

[76] Inventor: Elmer D. Foster, 824 W. 200 South, Salt Lake City, Utah 84104

[21] Appl. No.: 801,962

[22] Filed: Feb. 18, 1997

[51] Int. Cl.[6] ..... H01Q 1/42

[52] U.S. Cl. ..... 343/840; 343/872

[58] Field of Search ..... 343/840, 872, 343/781 P, 781 R

[56] References Cited

U.S. PATENT DOCUMENTS 3,733,609 5/1973 Bartlett ..... 343/840

4,263,599 4/1981 Bielli et al. ..... 343/781 R 4,918,459 4/1990 De Teso ..... 343/840

5,680,145 10/1997 Thomson et al. ..... 343/915

*Primary Examiner*—Michael Tokar

*Assistant Examiner*—Qui Van Duong

[57] ABSTRACT

A satellite dish having a brim projecting forwardly thereof and from the sides and top portions of the dish to prevent snow and ice accumulation on the face of the dish, while providing minimal obstruction of a collected signal from a satellite and reflection of the collected signal to a horn feed of a television antenna system.

2 Claims, 1 Drawing Sheet

SATELLITE DISH WITH SHIELD

FIELD OF THE INVENTION

This invention relates to protective covers for use on satellite dishes.

PRIOR ART

For many years satellite dishes, even for home use were large structures, often having a face diameter of six feet or more. It has been common for such a dish to have snow and ice accumulate on the face thereof and under such circumstances to have the television picture transmitted by such dishes distorted or blacked out. It then becomes necessary to sweep the ice and snow from the dish face, without damaging the dish, to place the dish back into working condition. Even if no build up occurs, moisture collecting on the face of the dish will often result in a distorted television picture on a receiver electronically connected to the dish. There has not been a truly satisfactory way for keeping these larger type satellite dishes working perfectly during inclement weather.

More recently smaller satellite dishes have been developed and have become very popular. These smaller satellite dishes have also operated unsatisfactorily during inclement weather and it is not uncommon for a user of a smaller dish to have to remove snow and/or ice build-up from the usual parabolic face of the dish in order to obtain satisfactory operation of the dish. In addition, the feed horn spaced from a satellite dish to collect a signal focused by the dish face also ices up, on occasion, to adversely affect operation of the satellite dish and the signal electronically transmitted to a television receiver.

In the past various electric heating systems have been proposed for use with satellite dishes to prevent ice and snow accumulation. Such systems require frequent maintenance and continuing operation costs.

BRIEF DESCRIPTION OF THE INVENTION

Objects of the Invention

A principal object of the present invention is to provide a satellite dish including a shield that will stop or at least greatly reduce ice and snow build-up on the parabolic face of the satellite dish without, itself providing a significant reduction of received signal from a satellite.

Other objects are to provide a shield for a satellite dish that will protect the parabolic face of the satellite dish from rain and that will additionally limit build-up of ice and snow on the feed horn directed at the center of the satellite dish and used to transmit a television signal collected by the parabolic face of the dish.

Still another object is to provide a shield that, when installed on a satellite dish, does not involve any maintenance or continuing expense.

Features of the Invention

Principal features of the invention include a cantilevered brim extending from the periphery of a satellite dish face. The cantilevered brim is molded to, or fitted to, the outer edge of the dish and may include a lip extending over the dish periphery to conform to the back surface of the dish. Preferably the brim extends from all but a lower portion of the periphery of the dish. The brim projects from the dish to a maximum distance that will allow unobstructed signal transmission past the brim, from a satellite, to at least the greater portion of the dish face and reflection from the dish face to the end of the feed horn that is spaced from the face of the dish and at an angle below a center line through the dish. The brim may be adjustably mounted with respect to the periphery of the satellite dish such that the distance the brim projects from the periphery of the dish can be set as necessary to provide for maximum protection of the dish from the elements while maintaining the best possible signal collection and reflection to the feed horn.

Additional objects and features of the invention will become apparent to those skilled in the art to which the invention pertains and from the following detailed description and drawings.

THE DRAWING

In the drawing:

FIG. 1 is a perspective view of the satellite dish with shield of the invention;

FIG. 2, a side elevation view; and

FIG. 3 an enlarged section taken on the line 3—3 of FIG. 1.

DETAILED DESCRIPTION OF THE INVENTION

Figure 2:
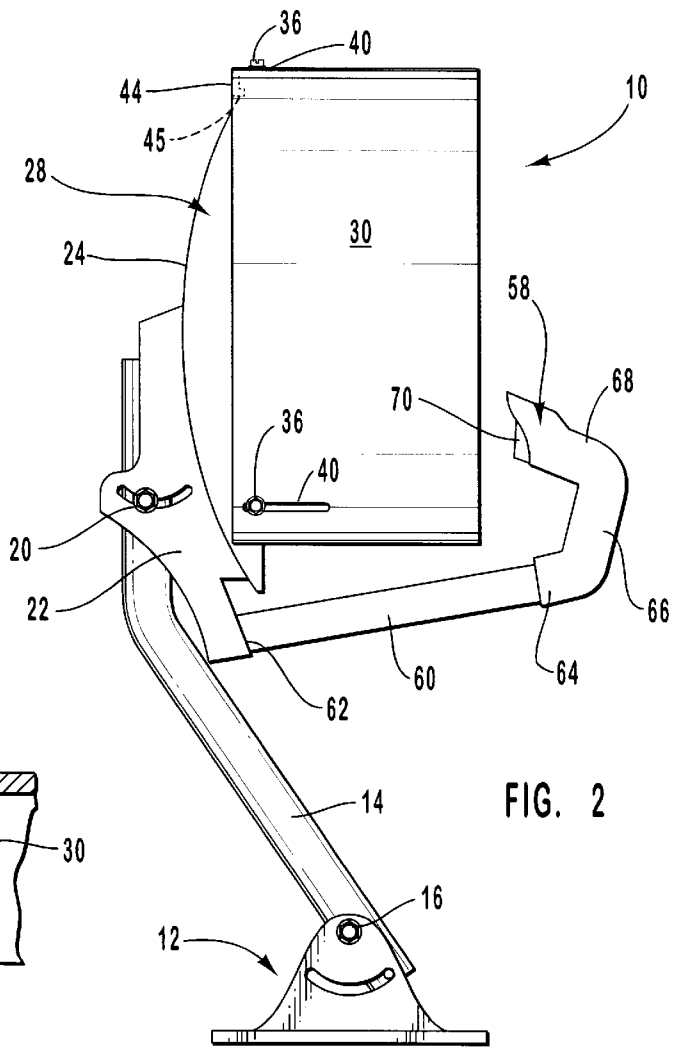
Figure 3:
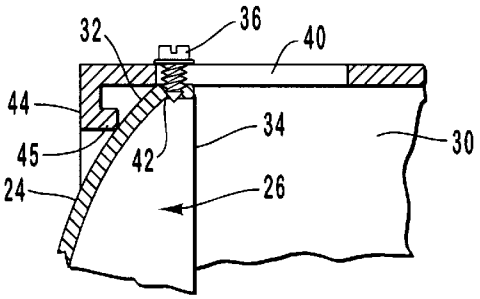
Figure 1:
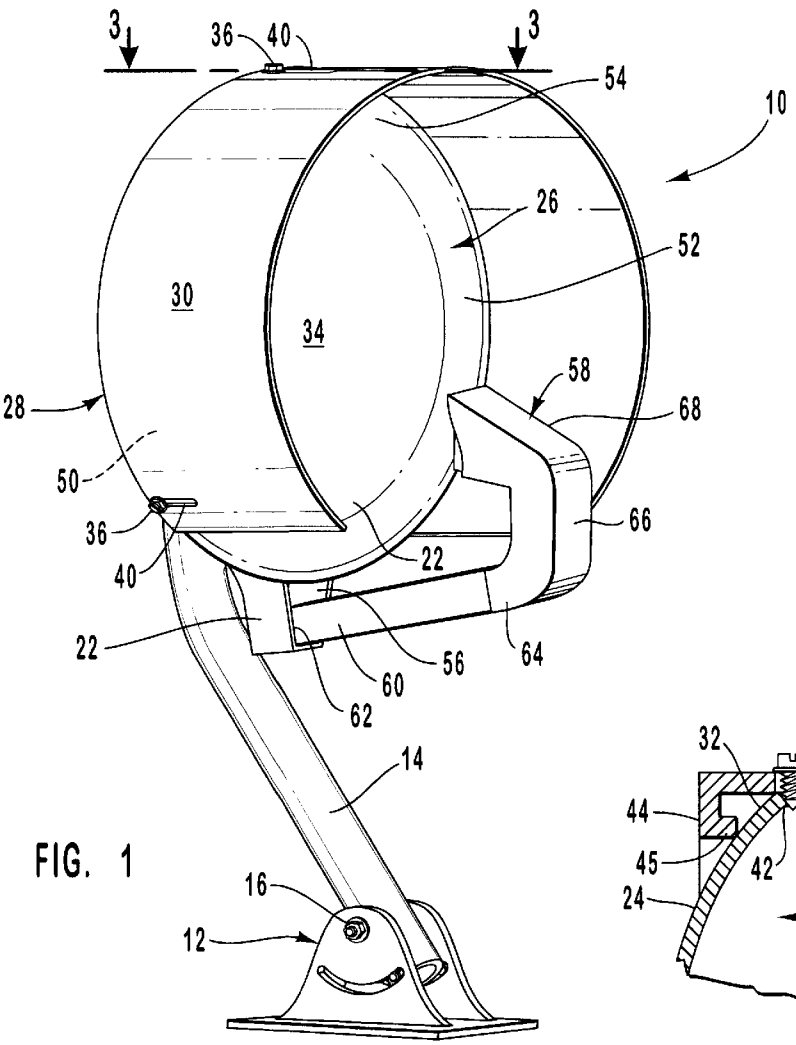

Referring now to the drawing:

In the illustrated preferred embodiment the satellite dish with shield is shown generally at 10. The satellite dish with shield 10 includes a mounting base 12 and a support post 14 having one end pivotally connected at 16 to the mounting base 12. The other end of the post 14 has a swivel connection 20 on which the arms 22 projecting from the back 24 of a dish 26 are mounted. The shield 28 of the invention includes a brim 30 that is formed around the outer periphery 32 of the dish 26. Brim 30 is cantilevered to project from the periphery 32 of the dish and beyond the face 34 of the dish. While a brim can be formed as one piece with the dish, the brim 30 is formed separately from the dish and is attached to the periphery 32 by screws 36. As shown brim 30 is made of a piece of flexible material that will wrap around the periphery 32. The screws 36 are inserted through elongate slots 40 formed in the brim 28 and are threaded into holes 42 provided therefor and spaced around the periphery 32. The brim 30 can be positioned to extend further outwardly of the face 34 of the dish or to extend to a more limited extent from the dish face by sliding the brim, with the screws 36 loosely threaded into the periphery 32. When the brim is most advantageously positioned the screws 36 are threaded fully into the periphery of the dish and are tightened to secure the brim against further movement.

A lip 44 is formed at the rear edge 46 of the brim 30. The lip 44 overhangs the back 24 of the satellite dish 26. The lip 44 limits forward movement of the brim 30 and helps to limit wind-blown wind and rain from passing between the periphery of the dish and the brim 30.

Brim 30, including lip 44, extends fully around opposite side areas 50 and 52 and the top area 54 of the periphery of the dish 24 but a bottom area 56 of the periphery is left open so that the cantilevered brim does not unduly obstruct collection of a satellite signal by the lower portion of the dish face or transmittal of the collected signal to a feeder horn 58.

Feeder horn 58 is mounted on an arm 60 shown attached at 62 to lower ends of arms 22. The feeder horn 58 then extends forwardly at 64, upwardly at 66 and rearwardly at 68 for a short distance, such that the receiving end 70 of the feeder horn is spaced forwardly of the receiver dish and will receive collected television signals reflected by the face of the dish. The manner in which satellite dishes collect television signals from a satellite and reflect them to a feeder horn and the conversion of such signals and transmission to a television receiver is well known.

Although a preferred form of my invention has been herein disclosed it is to be understood that the present embodiment is by way of example and that variations are possible without departing from the subject matter coming within the scope of the following claims, which subject matter I regard as my invention.

I claim:

1. A satellite dish comprising a dish antenna having a back and a parabolic face interconnected by a surrounding peripheral edge;

a brim extending from said peripheral edge at top and side portions thereof, said brim being cantilevered from said face of said dish antenna, formed separately from said dish and having a lip cantilevered to extend beyond the back of said dish;

means to secure said brim to said periphery of said dish comprising spaced screws around the brim screwed into said periphery of said dish; and adjustment means for setting the extent to which the entire brim projects from the face of the dish, said adjustment means comprising elongate slots formed in said brim through which said screws are passed into the periphery of the dish.

2. A shield for use on satellite dishes comprising a flexible brim adapted to wrap around the sides and top of a satellite dish and to be cantilevered beyond the face of the satellite dish, and having a lip cantilevered beyond the back of a wall of the satellite dish;

means to secure said flexible brim tightly around the periphery of said dish; and means to adjust the extent to which the entire portion of the flexible brim is cantilevered beyond the face of the satellite dish.

* * * * *